United States Patent [19]

Hancock et al.

[11] Patent Number: 4,885,993

[45] Date of Patent: Dec. 12, 1989

[54] SHAPED CHARGE WITH BIFURCATED PROJECTION FOR DETONATING CORD

[75] Inventors: Michael P. Hancock, Cleburne; Scott L. Hayes, Mansfield, both of Tex.

[73] Assignee: Goex, Inc., Cleburne, Tex.

[21] Appl. No.: 250,931

[22] Filed: Sep. 29, 1988

Related U.S. Application Data

[63] Continuation-in-part of Ser. No. 157,379, Feb. 17, 1988, Pat. No. 4,852,495.

[51] Int. Cl.[4] ..... F42B 1/02

[52] U.S. Cl. ..... 102/307; 102/312; 102/313; 102/275.8

[58] Field of Search ..... 102/306, 307, 312, 313, 102/275.7, 275.8

[56] References Cited

U.S. PATENT DOCUMENTS

| | | | |
|---|---|---|---|
| 3,143,068 | 8/1964 | Bell | 102/20 |
| 3,951,218 | 4/1976 | Sjogren | 175/4.6 |
| 4,326,462 | 4/1982 | Garcia et al. | 102/310 |
| 4,519,313 | 5/1985 | Leidel | 102/310 |
| 4,640,370 | 2/1987 | Wetzel | 175/4.6 |
| 4,657,089 | 4/1987 | Stout | 175/4.6 |
| 4,739,707 | 4/1988 | Regalbuto et al. | 102/307 |
| 4,784,061 | 11/1988 | Christopher | 102/306 |

*Primary Examiner*—Peter A. Nelson

*Attorney, Agent, or Firm*—Arthur F. Zobal; Geoffrey Mantooth

[57] ABSTRACT

A shaped charge has a case, a cap, and an O-ring. The case has first and second ends and a cavity therein. The case first end has a cylindrical first surface that circumferentially surrounds the cavity. The case second end has a bifurcated projection for receiving a portion of detonating cord. The cap also has first and second ends and cavity therein. The cap first end has a cylindrical second surface that circumferentially surrounds the cap cavity. The case and cap first ends matingly receive each other such that the first and second surfaces face each other. The first and second surfaces have respective circumferential grooves that are aligned with each other when the case and cap are assembled together. The grooves receive the O-ring, which retains the case and cap together while permitting the case to rotate relative to the cap. The cap second end is adapted to couple to a shaped charge carrier. The O-ring and groove arrangement provide a seal between the case and the cap and permit the alignment of the bifurcated projection with the shaped charge carrier while maintaining a secure coupling of the shaped charge to the carrier.

6 Claims, 2 Drawing Sheets

SHAPED CHARGE WITH BIFURCATED PROJECTION FOR DETONATING CORD

This is a continuation-in-part of application Ser. No. 157,379, filed Feb. 17, 1988, now U.S. Pat. No. 4,852,495.

FIELD OF THE INVENTION

The present invention relates to shaped charge well perforating apparatuses, and in particular to the shaped charges making up well perforating apparatuses.

BACKGROUND OF THE INVENTION

Well perforating apparatuses typically utilize shaped charges for perforating well casing. The individual shaped charges are mounted onto a shaped charge carrier strip in linear fashion. In some types of prior art shaped charges, the shaped charge is mounted to the carrier by screwing one end of the shaped charge into the carrier. At the other end of the shaped charge is a slot for receiving a portion of detonating cord. A length of detonating cord connects all of the shaped charges mounted onto the carrier.

When assembling the shaped charges onto the carrier, the slot of each shaped charge is aligned with the carrier such that the detonating cord can be kept parallel to the carrier. This prevents sharp turns in the detonating cord, which turns could stop a detonation from proceeding along the entire length of the detonating cord. In those prior art shaped charges that are screwed into the carrier, alignment of the detonating cord slot with the carrier is achieved by first screwing the shaped charge all the way into the carrier until tight and then unscrewing the shaped charge until the slot is aligned. Such an arrangement is undesirable because by unscrewing the shaped charge, the shaped charge is no longer firmly attached to the carrier. What is needed is a shaped charge that will allow the detonating cord slot to be aligned with the carrier while allowing the shaped charge to be tightly screwed into the carrier.

SUMMARY OF THE INVENTION

It is an object of the present invention to provide a shaped charge that permits the alignment of the detonating cord slot with the shaped charge carrier while maintaining a secure coupling of the shaped charge to the carrier.

The shaped charge of the present invention includes a case, a cap, and elastomeric seal means. The case has first and second ends and a cavity therein. The cavity opens to the case first end. The case second end has means for receiving a portion of a detonating cord. The cap also has first and second ends and a cavity therein. The cap cavity opens to the cap first end. The cap second end is adapted to be coupled to a shaped charge carrier. The case and cap are adapted to be assembled together by one of the first ends matingly receiving the other of the first ends. The case first end has a cylindrical first surface that circumferentially surrounds the case cavity and the cap first end has a cylindrical second surface that circumferentially surrounds the cap cavity. When the case and cap are assembled together, the first and second surfaces face each other and an enclosed cavity is formed from the case and cap cavities. The enclosed cavity receives an explosive charge. The first and second surfaces have respective circumferential grooves that are aligned with one another when the case and cap are assembled together. Both of the grooves receive the seal means, which provides a seal between the assembled case and cap. In addition to providing a seal, the seal means retains the case and the cap in the assembled condition while permitting rotation of the case relative to the cap.

The shaped charge of the present invention permits the alignment of the case second end relative to the shaped charge carrier after the shaped charge cap has been securely coupled to the carrier. The alignment of the case occurs without moving the cap or otherwise disturbing the coupling of the cap and the carrier.

In one aspect of the invention, the seal means is an O-ring.

DESCRIPTION OF THE PREFERRED EMBODIMENT

Figure 1:
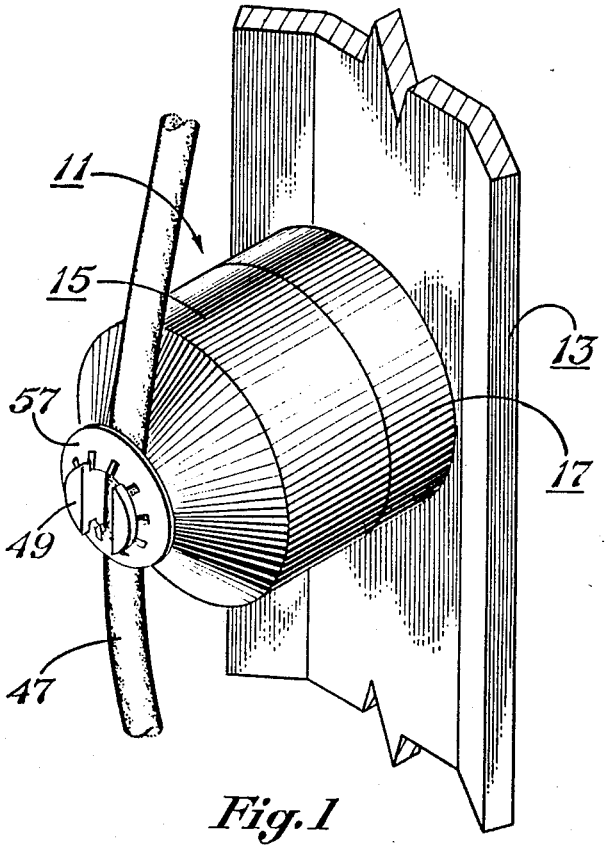
FIG. 1 is a schematic isometric view showing the shaped charge of the present invention, in accordance with a preferred embodiment.
Figure 2:
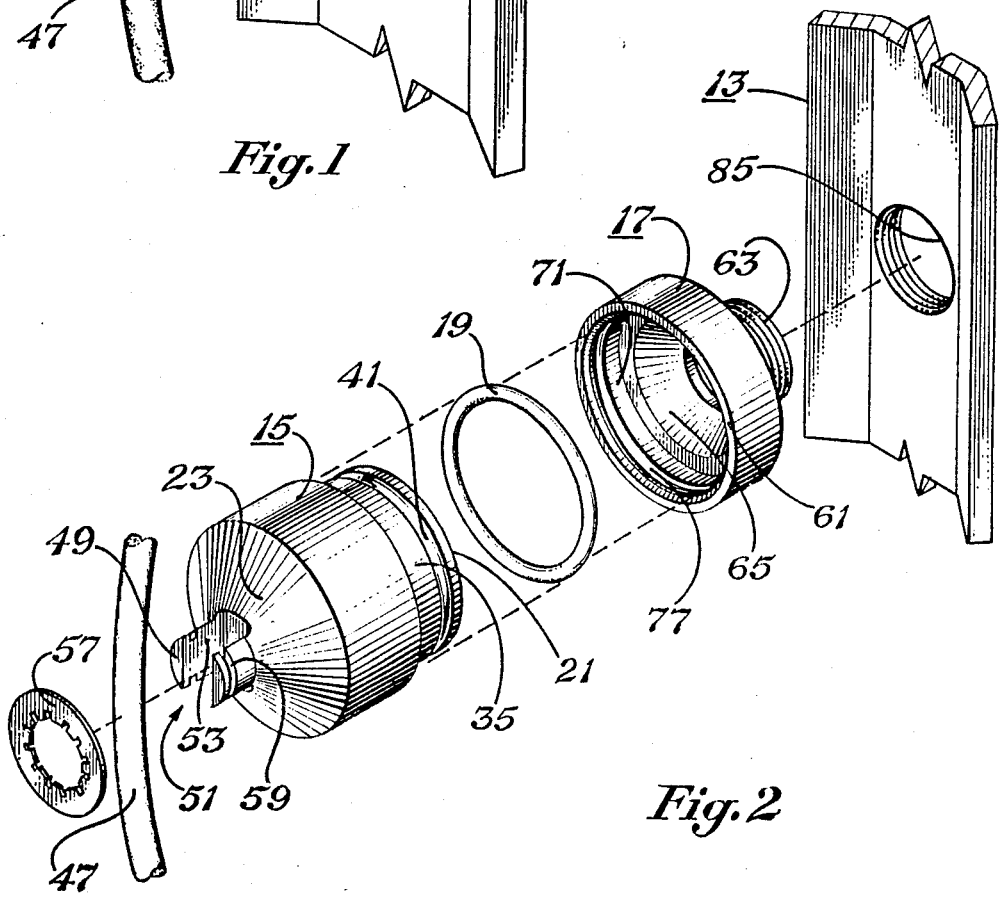
FIG. 2 is an exploded isometric view of the shaped charge of FIG. 1.

In FIGS. 1 and 2, there is shown a shaped charge 11 of the present invention, in accordance with a preferred embodiment, mounted onto a shaped charge carrier strip 13. In addition to the shaped charge 11 shown in FIGS. 1 and 2, there are usually a plurality of other similar shaped charges mounted onto the same shaped charge carrier 13. Such an assembly of shaped charges on a carrier is used to perforate well casing in oil or gas wells. The shaped charge of the present invention includes a case 15, a cap 17, and an elastomeric O-ring 19.

Figure 3:
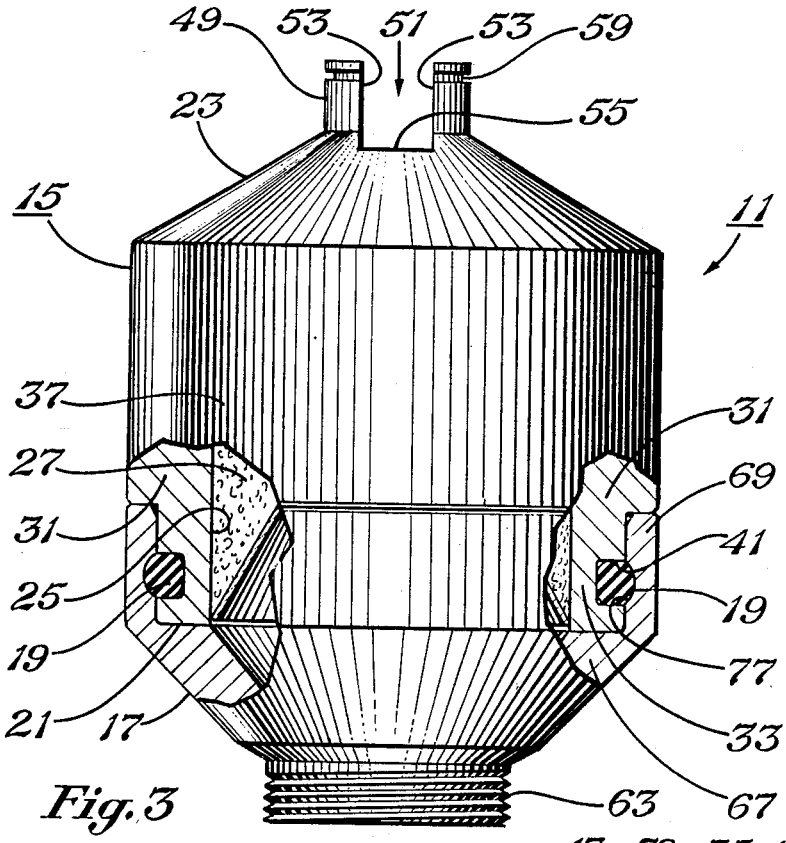
FIG. 3 is a partial cut away view of the shaped charge showing the O-ring arrangement.
Figure 4:
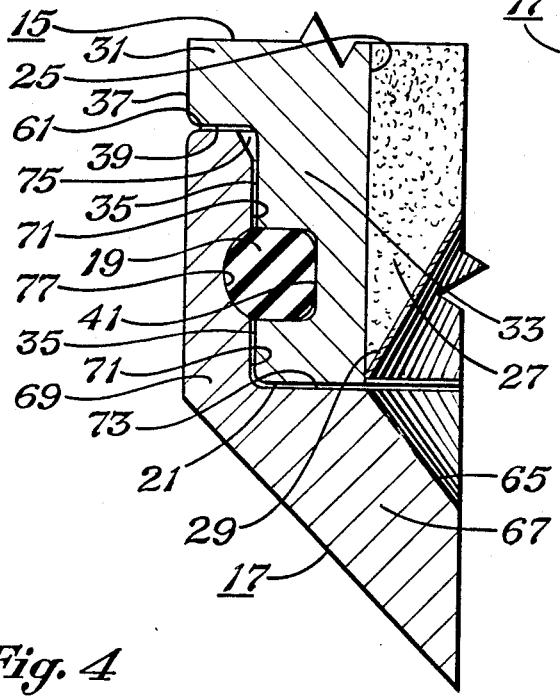
FIG. 4 is a detailed transverse cross-sectional view of the O-ring arrangement of FIG. 3.
Figure 5:
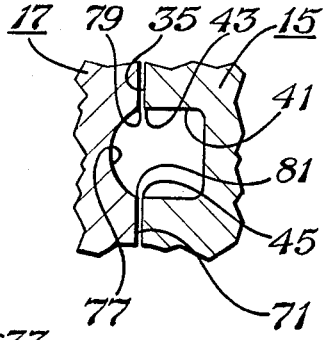
FIG. 5 is a detailed transverse cross-sectional view of the channel formed by the case groove and cap groove.

The shaped charge case 15 is generally cylindrical and has first and second ends 21, 23. Referring to FIGS. 3 and 4, the metal case 15 has a cavity 25 therein. The cavity 25, which receives an explosive charge 27 and a liner 29, opens to the case first end 21. A cylindrical side wall 31 extends from the first end 21 towards the second end 23. The case side wall 31 is reduced in thickness at the case first end 21, where it forms a lip 33. The outside portion of the lip 33 has a first surface 35 which is cylindrical and circumferentially surrounds the cavity 25 at the case first end 21 (see FIGS. 2 and 4). The first surface 35 is of a smaller diameter than the exterior surface 37 of the case 15. The first surface 35 merges with a shoulder surface 39 which in turn merges with the case exterior surface 37. The lip 33 has a circumferential groove 41 that opens to the first surface 35. Referring to FIG. 5, the groove 41 has first and second edges 43, 45 which are those edges where the groove intersects the first surface 35. The first edge 43 extends circumferentially around the lip 33 and is located in an imaginary transverse plane that is perpendicular to the first surface 35. Likewise, the second edge 45 extends circumferentially around the lip 33 and is located in another imaginary transverse plane that is perpendicular to the first surface 35. The distance between the first and second edges is sized slightly larger than the transverse cross-sectional diameter of the O-ring 19. The groove 41 has a rectangular transverse cross-section such that the distance between the first and second edges 43, 45 exceeds the groove's depth of penetration into the lip 33. The rectangular cross-section of the groove causes a portion of the O-ring to protrude out from the first surface 35.

The second end 23 of the case 15 has provision for receiving a portion of a length of detonating cord 47 (see FIGS. 1–3). The second end 23 has a projection 49 that extends in a direction opposite of the first end 21 of the case 15. The projection 49, which is cylindrical, is bifurcated to form a slot 51 having sides 53. At the closed end of the slot 51 is a booster wall 55. The booster wall 55 separates the portion of the detonating cord 47 located in the slot 51 from the explosive charge 27. The width of the slot 51 (the distance between the slot sides 53) is only very slightly greater than the diameter of the detonating cord 47. The depth of the slot 51 (the distance from the booster wall 55 to the free end of the projection 49) is such that the detonating cord 47 can be positioned contiguous to the booster wall 55, while allowing a retainer means in the form of a spring metal push nut 57 to be pressed onto the projection 49. Near the free end of the projection 49 is a circumferential groove 59, for receiving and capturing the push nut 57.

The cap 17 is generally cylindrical and has first and second ends 61, 63. The metal cap 17 has a cavity 65 therein, which opens up towards the cap first end 61. A side wall 67 extends from the first end 61 towards the second end 63. A counterbore at the first end 61 of the cap reduces the thickness of the side wall 67 so as to form a lip 69. The inside portion of the lip 69 has a second surface 71 which is cylindrical and circumferentially surrounds the cap cavity 65 (see FIGS. 2 and 4). The second surface 71 merges with a shoulder surface 73 which in turn merges with the surface defining the cap cavity 65. The second surface 71 also merges with a beveled surface 75 which in turn merges with the first end 61. The beveled surface 75 eases assembly of the cap 17 over the O-ring 19 and onto the case 15. The diameter of the second surface 71 is slightly greater than the diameter of the first surface 35, while the longitudinal length (the distance between the respective first end and the respective shoulder surface) of the second surface is about the same as that of the first surface. The cap lip 69 has a circumferential groove 77 that opens to the second surface 71. The cap groove 77 has a transverse cross-section that is arcuate in shape and is sized smaller than a semi-circle. The cap groove 77 has first and second edges 79, 81, which are those edges where the groove 77 intersects the second surface 71 (see FIG. 5). The distance between the first and second edges 79, 81 of the cap groove 77 is the same as the distance between the first and second edges 43, 45 of the case groove 41. The cap groove 77 is located along the cylindrical second surface 71 such that when the cap 17 is assembled onto the case 15 the first and second edges 79, 81 of the cap groove 77 are located in the same respective transverse planes as the respective first and second edges 43, 45 of the case groove 41.

The second end 63 of the cap 17 is a cylindrical member of smaller diameter than the cap side wall 67. The second end 63 is threaded so as to matingly engage a threaded opening 85 in the shaped charge carrier 13.

To assemble the shaped charge 11 of the present invention, the O-ring 19 is assembled into the case groove 41. A portion of the O-ring 19 protrudes outwardly from the first surface 35. Next, the cap 17 is assembled onto the case 15 by inserting the first end 21 of the case into the first end 61 of the cap. The beveled surface 75 of the cap 17 aids in assembly by compressing the O-ring 19. The case 15 is forcefully inserted into the cap 17 until that portion of the O-ring 19 which protrudes from the first surface 35 of the case is received by the cap groove 77, wherein the cap is now retained onto the case by the O-ring. When the shaped charge 11 is assembled, the first and second surfaces 35, 71 face each other, being separated only by a small clearance and with the second surface completely surrounding and overlapping the first surface. The case cavity 25 combines with the cap cavity 65 to form a single cavity inside of the shaped charge 11. The case first end 21 faces the cap shoulder surface 73 and the cap first end 61 faces the case shoulder surface 39. The case groove 41 is aligned with the cap groove 77 such that the respective first edges 43, 79 lie in one transverse plane and the second edges 45, 81 lie in another transverse plane. Referring to FIG. 5, the alignment of the case groove 41 with the cap groove 77 forms a channel for receiving the O-ring (in FIG. 5 the O-ring is not shown for clarity), which channel surrounds the single cavity inside of the shaped charge such that the O-ring 19 provides a circumferential seal between the case and the cap. The O-ring 19 also lies in a plane which is perpendicular to the first and second surfaces 35, 71.

The assembled shaped charge 11 is mounted onto the shaped charge carrier 13 by screwing the second end 63 of the cap 17 into the threaded opening 85 in the carrier, until a tight fit is achieved. Then, the case 15 is rotated relative to the cap 17 to bring the slot 51 into parallel alignment with the carrier 13, as shown in FIG. 1. This allows the detonating cord 47 to be assembled onto the shaped charge so as to run parallel to the carrier 13. A portion of the detonating cord 47 is laid into the slot 51, such that the detonating cord portion contacts the booster wall 55. Then, the push nut 57 is pressed onto the projection 49 until the push nut is received and captured by the circumferential groove 59.

The case 15 is permitted to rotate relative to the cap 17 and the carrier 13 by virtue of the O-ring retainer arrangement. The overlapping cylindrical first and second surfaces 35, 71 limit movement of the case relative to the cap to longitudinal movement and rotational movement. Longitudinal movement, wherein the case and cap separate, is resisted by the O-ring 19, a portion of which is received by each groove 41, 77. As the case 15 and the cap 17 are pulled apart, the first edge 79 of the cap groove 77 and the second edge 45 of the case groove 41 encounter resistance from the O-ring 19. This resistance can be overcome only by using great force to compress the O-ring 19, wherein the case 15 and cap 17 can separate. The amount of force that is required to separate the case and the cap is much greater than force encountered by the shaped charge during normal use.

The O-ring 19, however, allows rotational movement, because as the case 15 rotates relative to the cap 17, the case groove 41 remains in the same position relative to the cap groove 77. The O-ring provides minimal resistance to rotation in the form of friction between the metal grooves and the elastomeric O-ring. The case 15 can be rotated without disturbing the coupling between the cap 17 and the carrier 13. A lubricant (not shown) may be applied to the first and second surfaces 35, 71 and to the O-ring 19 to ease the rotation of the case relative to the cap.

In the preferred embodiment, the O-ring 19 is made of either a high temperature resistant fluorocarbon or a nitrile rubber. The O-ring 19 is a 100 series O-ring and has a transverse cross-sectional diameter of 0.103 inches. The distance between the first and second edges of the case groove 41 is about 0.110 inches and the case groove penetrates about 0.073 inches into the case lip 33. The cap groove 77 penetrates about 0.018 inches into the cap lip. For ease of assembly, about 80% of the O-ring 19 is received by the case groove 41 with the remaining 20% of the O-ring received by the cap groove 77. When the cap and case are assembled together the clearance between the first and second surfaces 35, 71 is about 0.002 inches (in FIG. 4 the clearances are exaggerated for clarity). The explosive charge is, among numerous possibilities, cyclonite (commonly referred to as RDX).

The foregoing disclosure and the showing made in the drawings are merely illustrative of the principles of this invention and are not to be interpreted in a limiting sense.

We claim:

1. A shaped charge, comprising:

(a) a shaped charge case having first and second ends and a cavity therein, said case cavity opening up to said case first end, said case first end having a cylindrical first surface that is circumferential, said first surface having a circumferential groove;

(b) a shaped charge cap having first and second ends and a cavity therein, said cap cavity opening up to said cap first end, said cap first end having a cylindrical second surface that is circumferential, said second surface having a circumferential groove, said cap second end being adapted to couple to a shaped charge carrier;

(c) elastomeric seal means fitted inside of said first surface groove;

(d) said first surface groove having a depth such that when said seal means is fitted into said first surface groove a portion of said seal means protrudes from said first surface;

(e) said case and said cap being assembled together to form an enclosed cavity from said case and cap cavities by one of said first ends matingly receiving the other of said first ends such that during assembly one of said first or second surfaces slides over the other of said first or second surfaces, the assembled case and cap forming a single cavity from said case cavity and said cap cavity, when said case and said cap are assembled together said first and second surfaces face one another and said first surface groove is aligned with said second surface groove, with said portion of said seal means that protrudes from the first surface being received by said cap groove;

(f) said seal means lies in a plane which is perpendicular to said first and second surfaces;

(g) said seal means retains said cap and said case together while allowing said case to rotate relative to said cap and while providing a circumferential seal between said case and said cap;

(h) said cap second end is threaded so as to be adapted to screw into a threaded opening on a shaped charge carrier;

(i) said case second end has a projection means projecting from said second end, said projection means being bifurcated to form a slot for receiving a portion of a length of detonating cord, said projection means adapted to receive retaining means for retaining said detonating cord in said slot.

2. The shaped charge of claim 1 comprising an explosive charge located in said single cavity formed from said case cavity and said cap cavity.

3. A shaped charge, comprising:

a first member comprising wall structure forming a cavity;

said wall structure of said first member having first and second ends with an opening at said first end leading to said cavity and formed by surrounding wall structure having an outward facing surface forming the outer boundary of said surrounding wall structure;

a second member comprising wall structure forming a cavity;

said wall structure of said second member having first and second ends with an opening at said first end of said second member leading to said cavity and formed by surrounding wall structure having an inward facing surface forming the inner boundary of said surrounding wall structure of said second member;

first groove means formed in said outward facing surface of said surrounding wall structure of said first member, second groove means formed in said inward facing surface of said surrounding wall structure of said second member, said first and second members being adapted to be assembled together with said first end of said first member located within said opening of said second member to form an enclosed cavity, for holding an explosive charge, with said inward and outward facing surfaces facing each other and with said first and second groove means being aligned with each other, seal means adapted to be located in said first and second groove means when said first and second members are assembled together for forming a seal between said two surfaces and for retaining said first and second members together while allowing said two members to rotate relative to each other, means at said second end of one of said members for coupling said one member to a shaped charge carrier, two spaced apart projection means coupled to said second end of the other of said members and extending away from said second end terminating in two spaced apart free ends forming a slot which extends from said free ends toward said second end for receiving a portion of a detonating cord;

each of said spaced apart projection means having an outer side wall means and an inner side wall means with said inner side wall means of said two spaced apart projection means facing each other;

said slot being defined as having two spaced apart side openings and an opening at said free ends whereby a detonating cord portion may be located in said slot from said opening at said free end to extend through said slot by way of said two side openings; and retainer means having an opening for receiving said two spaced apart projection means such that said retainer means may be located at least partially around said outer side wall means of said two spaced apart projection means and positioned between said denotating cord portion, when located in said slot, and said free ends and across at least one of said side openings of said slot for retaining said detonating cord portion in said slot for allowing said detonating cord to be used for detonating said explosive charge.

4. The apparatus of claim 3 wherein:

said retainer means comprises an annular retainer means having an opening for receiving said two projection means such that said annular retainer means may be located around said two spaced apart projection means and positioned between said detonating cord portion, when located in said slot, and said free ends and across said two side openings of said slot.

5. The apparatus of claim 4 comprising:

groove means formed in said outer side wall means of said two projection means between said second end and said free ends for receiving at least the inner edge of said annular retainer means.

6. The apparatus of claim 5 wherein:

said annular retainer means comprises a flat disc like, flexible, metal push nut which when located around said two projection means, the outer periphery of said flat disc like, flexible, metal push nut may be located closer to said second end than the inner periphery of said flat disc like, flexible, metal push nut.

* * * * *